US005274976A

United States Patent [19]

Burkhart

[11] Patent Number: 5,274,976

[45] Date of Patent: Jan. 4, 1994

[54] WINDOW UNIT WITH DECORATIVE GRILLE ASSEMBLY

[75] Inventor: E. Wayne Burkhart, Venice, Fla.

[73] Assignee: Vinyl Tech, Venice, Fla.

[21] Appl. No.: 666,695

[22] Filed: Mar. 8, 1991

[51] Int. Cl.[5] ..... E06B 3/68

[52] U.S. Cl. ..... 52/456; 52/314; 52/507; 52/656.8; 52/656.9

[58] Field of Search ..... 52/456, 507, 314, 656, 52/664, 665, 656.1, 656.8, 656.9, 456

[56] References Cited

U.S. PATENT DOCUMENTS

| | | | |
|---|---|---|---|
| 1,991,359 | 2/1935 | Blake . | |
| 3,307,316 | 3/1967 | Gray | 52/314 |
| 3,372,522 | 3/1968 | Engstrom | 52/507 |
| 3,381,431 | 5/1968 | Jacobson | 52/507 |
| 3,411,258 | 11/1968 | Kessler . | |
| 3,474,587 | 10/1969 | Martin . | |
| 3,645,058 | 2/1972 | Jacobson et al. | 52/507 X |
| 3,686,814 | 8/1972 | Anderson | 52/507 X |
| 4,570,406 | 2/1986 | DiFazio | 52/656 |
| 4,610,901 | 9/1986 | Linscott . | |
| 4,723,388 | 2/1988 | Zieg . | |
| 4,890,435 | 1/1990 | Wilkening et al. . | |
| 4,949,521 | 8/1990 | Riegelman et al. | 52/456 |
| 4,970,840 | 11/1990 | Ouellett et al. | 52/507 X |
| 5,099,626 | 3/1992 | Seeger | 52/314 |

FOREIGN PATENT DOCUMENTS

| | | | |
|---|---|---|---|
| 2637034 | 2/1978 | Fed. Rep. of Germany | 52/656 |

*Primary Examiner*—Carl D. Friedman
*Assistant Examiner*—Robert Canfield
*Attorney, Agent, or Firm*—Burns, Doane, Swecker & Mathis

[57] ABSTRACT

A window contains a decorative grille bar assembly which is mounted atop a single glazing panel to simulate the presence of separate window panes. The grille bar assembly comprises a plurality of hollow metal extrusions which are connected to one another, and to the window frame, by plastic inserts which are press-fit in hollow ends of the grille bars. The inserts are connected to the grille bars and to the window frame by tongue-and-recess connections.

12 Claims, 8 Drawing Sheets

Fig. 8
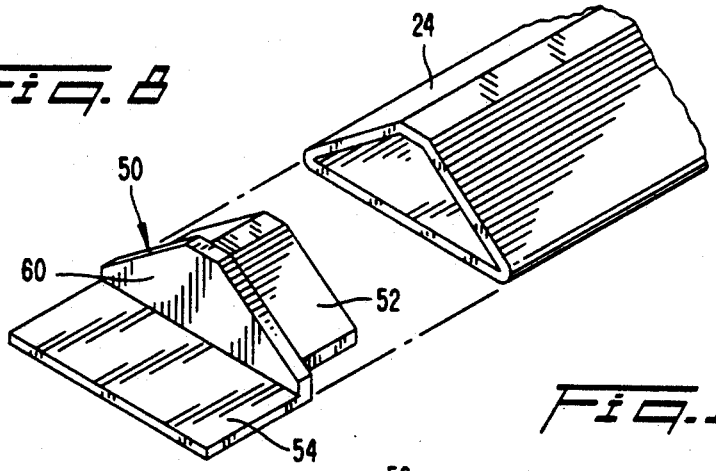
Fig. 10
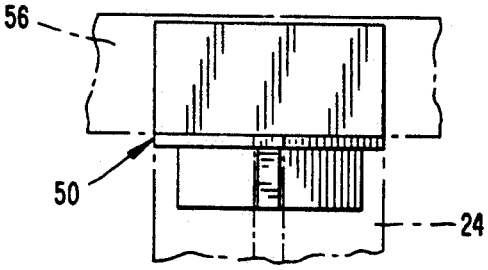
Fig. 9
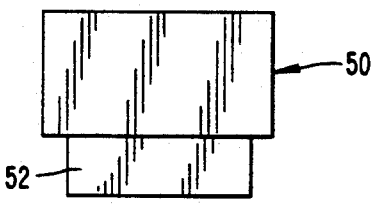
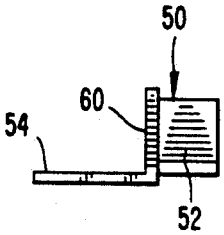
Fig. 11
Fig. 12
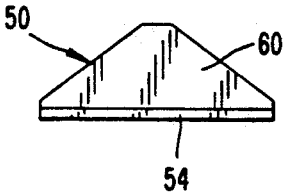
Fig. 13
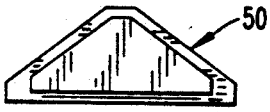
Fig. 14
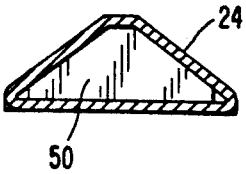
Fig. 15
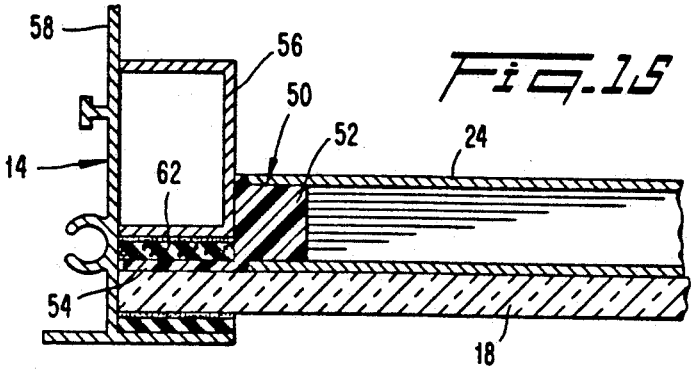

Fig. 25
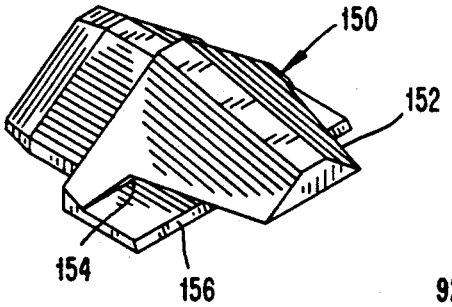
Fig. 27
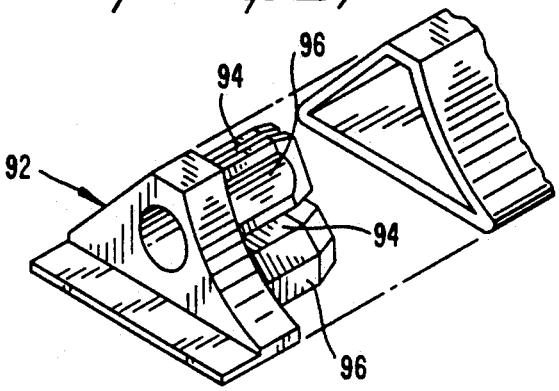
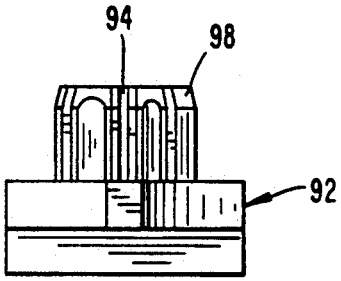
Fig. 28
Fig. 29
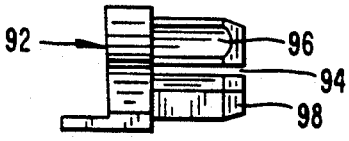
Fig. 30
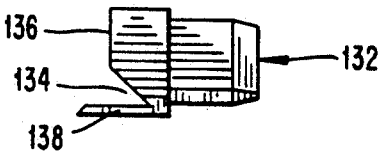
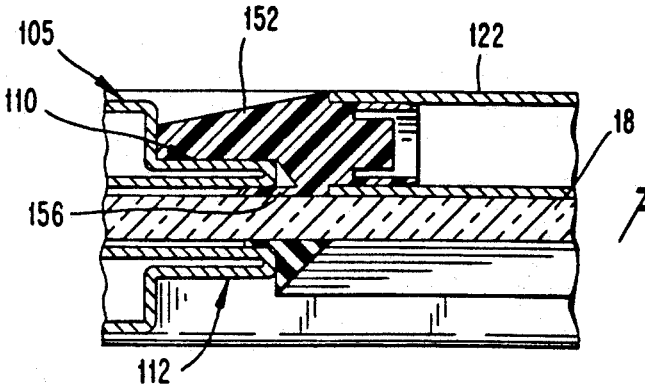
Fig. 26

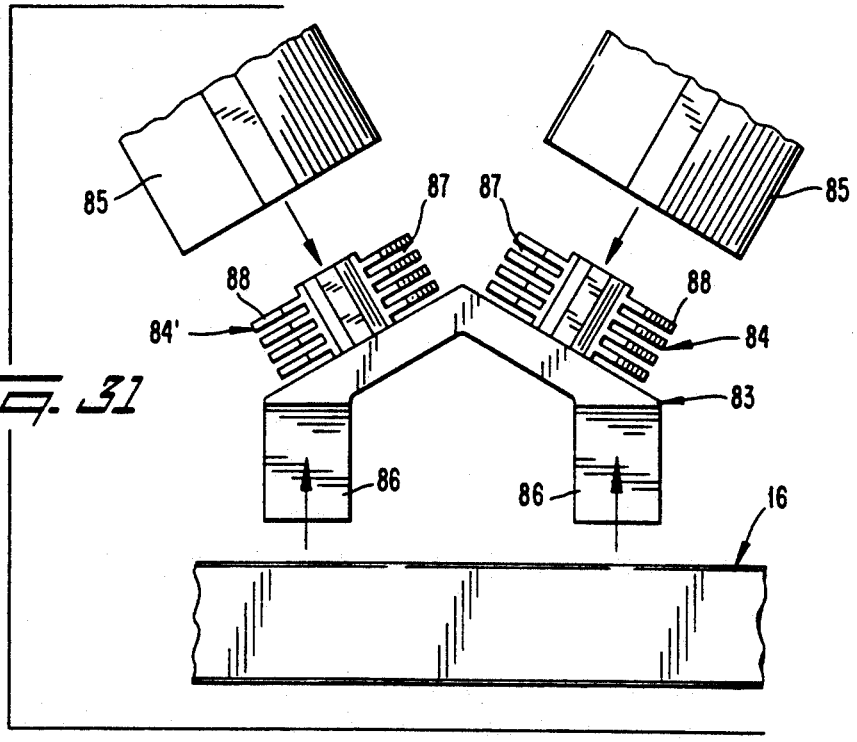
Fig. 31
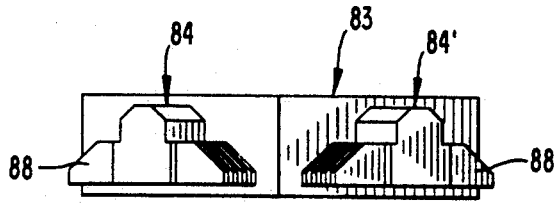
Fig. 32
Fig. 33
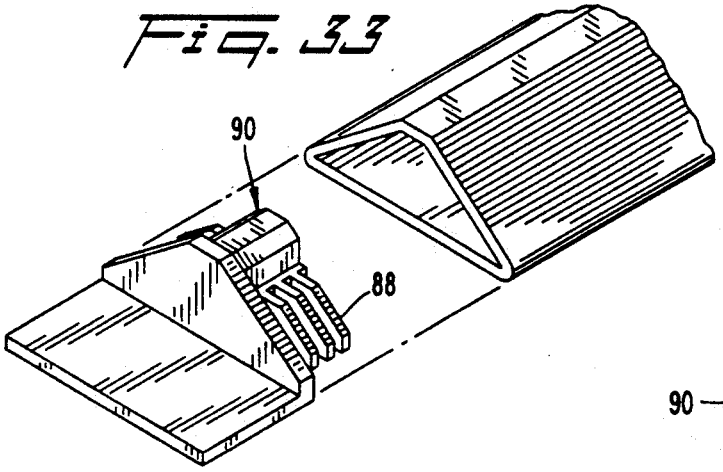
Fig. 34
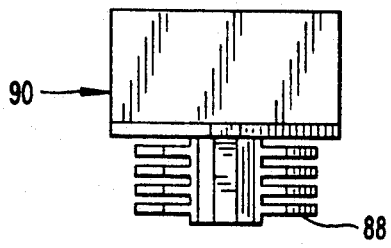

WINDOW UNIT WITH DECORATIVE GRILLE ASSEMBLY

BACKGROUND OF THE INVENTION

The present invention relates to window or glazing units such as used on windows and doors and, in particular, to decorative grille or muntin assemblies which overlie a glazing panel.

It is conventional to overlie a glazing panel of a window with a decorative grille or muntin assembly so as to create the appearance of a multi-panel window. One such assembly is described in U.S. Pat. No. 4,890,435.

Another conventional decorative grille assembly comprises a plurality of hollow metal extrusions of triangular cross-section which are welded together to form a grille-shaped unit. The free ends of the extrusions are partially cut away to form projecting legs. The thus-formed grille unit is laid upon a glazing panel which is carried by a peripheral frame. A portion of the frame comprises a rail that is laid upon the window in overlying relationship to outer ends of the projecting legs to hold the unit in place. The unit is resistant to high heat due to the extrusions being formed of metal. Such an arrangement is, however, expensive to manufacture because of the numerous steps involved in welding the extrusions together and cutting the ends of the extrusions to form the projecting legs.

SUMMARY OF THE INVENTION

The present invention relates to a window unit which comprises a frame, a glazing panel mounted in the frame, and a decorative grille assembly overlying the glazing panel and retained in place by the frame. The grille assembly comprises a plurality of grille bars formed of hollow metal extrusions, and plastic inserts stationarily mounted in hollow ends of the metal grille bars and projecting longitudinally therebeyond. Some of the plastic inserts interconnect the grille bars together by tongue-and-recess connections. Preferably, others of the plastic inserts connect the grille assembly to the frame also by tongue-and-recess connections.

BRIEF DESCRIPTION OF THE DRAWINGS

The objects and advantages of the invention will become apparent from the following detailed description of preferred embodiments thereof in connection with the accompanying drawings, in which like numerals designate like elements, and in which:

FIG. 8 is a fragmentary exploded view of a second form of insert according to the present invention;

FIG. 9 is a bottom plan view of the insert depicted in FIG. 8;

FIG. 10 is a top plan view of the insert depicted in FIG. 8, with a part of the frame and a secondary grille bar being depicted in phantom;

FIG. 11 is a side elevational view of the insert depicted in FIG. 8;

FIG. 12 is an end view of the first end of the insert depicted in FIG. 8;

FIG. 13 is an end view of a second end of the insert depicted in FIG. 8;

FIG. 14 is a sectional view taken along the line 14—14 in FIG. 1;

FIG. 15 is a sectional view taken along the line 15—15 in FIG. 1;

FIG. 25 is a perspective view of a fourth type of insert according to the present invention;

FIG. 26 is a sectional view taken along the line 26—26 in FIG. 23;

FIG. 27 is a perspective exploded view of a fifth type of insert according to the present invention;

FIG. 28 is a top plan view of the insert depicted in FIG. 27;

FIG. 29 is a side elevational view of the insert depicted in FIG. 27;

FIG. 30 is a side elevational view of a sixth preferred form of insert according to the present invention;

FIG. 31 is an exploded plan view of a seventh preferred type of insert according to the present invention;

FIG. 32 is an end view of the insert depicted in FIG. 31;

FIG. 33 is a perspective view of an eighth type of insert according to the present invention; and FIG. 34 is a top plan view of the insert depicted in FIG. 33.

DETAILED DESCRIPTION OF PREFERRED EMBODIMENTS OF THE INVENTION

Figure 1:
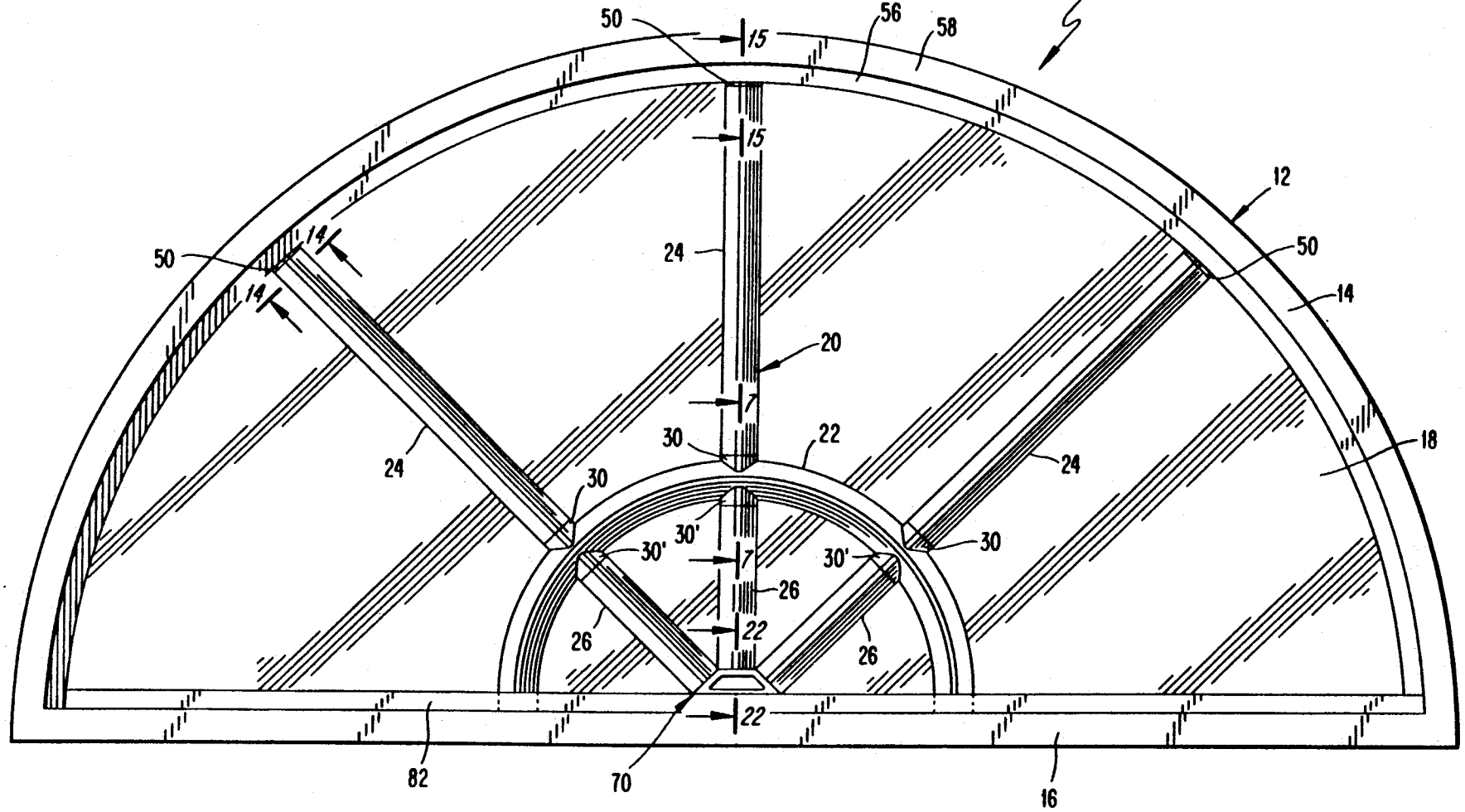
FIG. 1 is a front elevational view of a semi-circular window having a grille assembly according to a first embodiment of the invention.

Described hereinafter are two preferred embodiments of window units and decorative grille assemblies according to the invention. One of those embodiments, depicted in FIG. 1 relates to a semi-circular window 10, and the other embodiment, depicted in FIG. 23, relates to a rectangular window 99.

The semi-circular window 10 comprises a frame 12 which includes a semi-circular section 14 and a linear section 16 interconnecting the ends of the semi-circular section 14. A glazing panel 18 is connected at its periphery to the frame 12 in any conventional manner.

Figure 2:
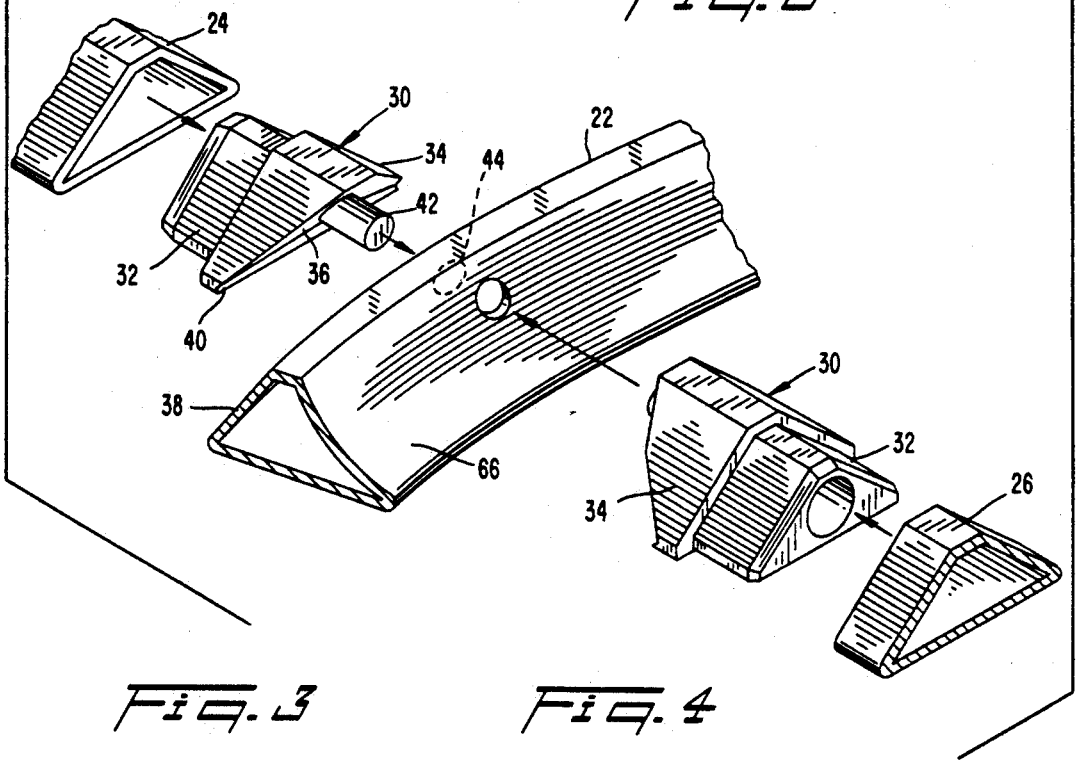
FIG. 2 is a fragmentary exploded view of a portion of the grille assembly depicted in FIG. 1.
Figure 3:
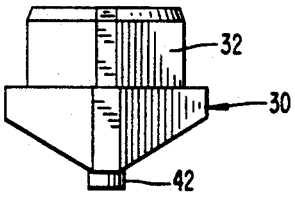
FIG. 3 is a top plan view of one type of plastic insert according to the present invention.
Figure 4:
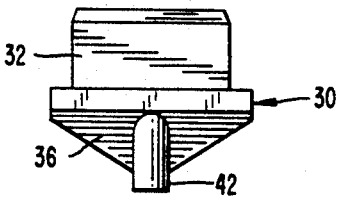
FIG. 4 is a bottom plan view of the insert depicted in FIG. 3.
Figure 5:
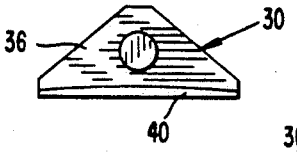
FIG. 5 is an end view of a first end of the insert depicted in FIG. 3.
Figure 6:
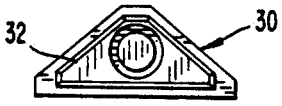
FIG. 6 is an end view of a second end of the insert depicted in FIG. 3.

Overlying the glazing panel is a grille assembly 20 which is held in place by the frame 12. The grille assembly 20 comprises a main grille bar 22 which is of curved, preferably semi-circular extension. Opposite ends of the main grille bar extend to different locations on the linear section 16 of the frame. Extending generally radially relative to the main grille bar are a plurality of secondary grille bars, e.g., outer secondary grille bars 24 and inner secondary grille bars 26. The main grille bar 22 and the secondary grille bars 24, 26 comprises hollow metal extrusions (e.g., aluminum) of triangular cross section (see FIG. 2).

Figure 7:
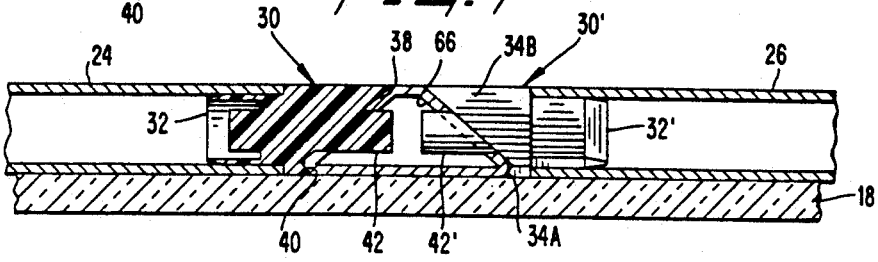
FIG. 7 is a sectional view taken along the line 7—7 in FIG. 1.

Each of the outer secondary grille bars 24 has one end situated adjacent the main grille bar 22 and another end situated adjacent the semi-circular section 14 of the frame 12. Mounted in the end of the outer secondary grille bar 24 disposed adjacent the main grille bar is a plastic insert 30. The plastic insert 30 includes a mounting portion 32 having a cross-sectional shape corresponding to that of the secondary grille bar, i.e., generally triangular, and is sized to be press or friction-fit therein to be held by a friction fit. An exposed portion 34 of the plastic insert also has a cross section shaped similarly to the secondary grille bar 24 (i.e., generally triangular) to simulate a longitudinal extension of the secondary grille bar. The portion 34 includes an inner section 34A disposed proximate the glazing panel, and an outer section 34B disposed remote from the glazing panel. The outer section 34B projects beyond its respective grille bar by a greater distance than the inner section 34A. The terminal end of the exposed portion 34 includes a face 6 which is inclined so as to lie against an outer side wall 38 of the main grille bar 22. That terminal end includes a lip 40 which underlies the main grille bar 22 (see FIG. 7) to resist separation therebetween in a direction perpendicular to the plane of the glazing panel.

Projecting longitudinally outwardly from the inclined face 36 is a post 42 which fits into a hole 44 formed in the outer side wall 38 of the main grille bar. The insert 30 is thus connected to the secondary grille bar by a tongue-and-recess type of connection defined by the mounting portion 32 of the insert and the hollow end of the secondary grille bar 24. The insert is connected to the main grille bar 22 also by a tongue-and-recess connection defined by the post 42 and the hole 44.

Disposed in the end of each outer secondary grille bar 24 situated adjacent the frame 12 is a plastic insert 50 (see FIGS. 8-15). That insert 50 includes a mounting portion 52 press fit into the hollow end of the secondary grill bar 24, and a tab 54 projecting longitudinally from an exposed end of the insert. The tab 54 is situated so as to lie against the glazing member 18 and be retained by a removable rail 56 of the semi-circular section of the frame.

The primary part 58 and the removable rail 56 form the semi-circular section of the frame. The rail 56 is positionable along an inside edge of the primary frame part 58 (see FIG. 15). The distance from an outer flat surface 60 of the plastic insert to the primary frame part substantially corresponds to the width of the removable rail part 56. Therefore, the removable rail 56 can be positioned in overlying relation to the tabs 54 of the inserts.

Carried along a bottom surface of the rail 56 is a strip 62 of a flexible material, such as a foam strip which is adhered by adhesive to the rail 56 (see FIG. 15). That strip bears against the glazing panel and the tabs 54 of the inserts 50. The tabs 54 and removable rail 56 thus define tongue-and-recess connections which mount the plastic inserts 50 to the frame 12.

The straight rail section includes V-shaped notches (not shown) adapted to receive the ends of the main grille bar and thereby anchor the main grille bar immovably in position relative to the frame.

The inner secondary grille bars 26 are connected to an inner side 66 of the main grille bar by plastic inserts 30' similar to the type 30 previously described, and to the frame 12 by means of a plastic insert 70. The insert 30' thus includes a mounting portion 32' received in the inner grille bar 26, and a post 42' received in a hole in the inner side 66 of the main grille bar 22.

Figure 16:
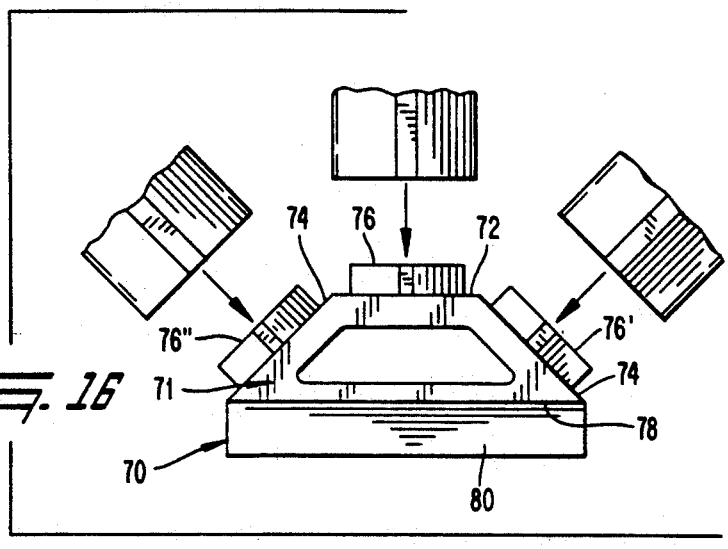
FIG. 16 is a top plan view of a third form of insert according to the present invention.
Figure 17:
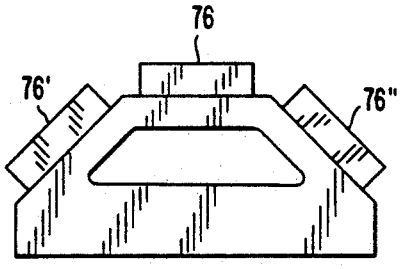
FIG. 17 is a bottom plan view of the insert depicted in FIG. 16.
Figure 18:
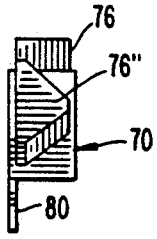
FIG. 18 is a side view of a first side of the insert depicted in FIG. 16.
Figure 19:
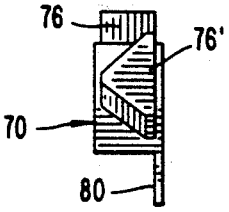
FIG. 19 is a side view of a second side of the insert depicted in FIG. 16.
Figure 20:
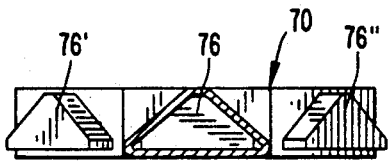
FIG. 20 is an end view of a first end of the insert depicted in FIG. 16, with a secondary grille bar shown in cross-section.
Figure 21:
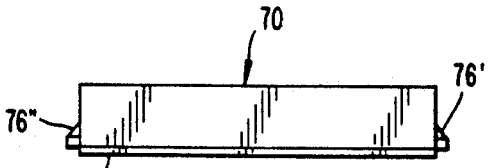
FIG. 21 is an end view of a second end of the insert depicted in FIG. 16.
Figure 22:
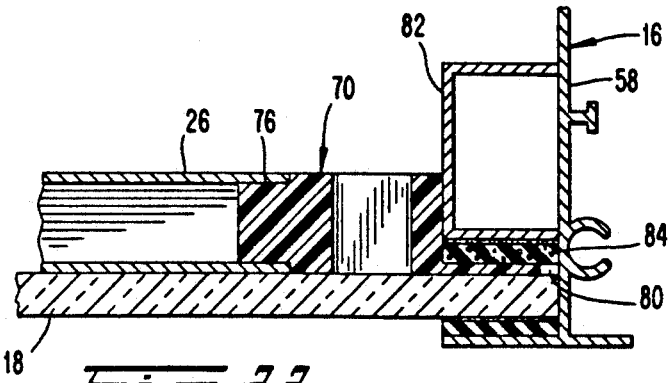
FIG. 22 is a sectional view taken along the line 22—22 in FIG. 1.

The insert 70 (see FIG. 16) comprises a trapezoidally shaped base portion 71 having a first face 72 oriented parallel to the linear section 16 of the primary frame 12 part, and two inclined faces 74. Each of the three faces 72, 74 carries a generally triangular mounting portion 76, 76', 76" adapted to be press fit into the hollow ends of the inner secondary grille bars (see FIG. 22).

Projecting from a surface 78 of the common insert facing the frame 12, is a tab 80 adapted to underlie a straight removable rail 82 of the linear frame section 16 so as to be engaged by a flexible foam strip 84 of the latter. Thus, the insert 70 is connected to the inner secondary grille bars by a tongue-and-recess connection 26, 76, and to the frame 12 by a tongue-and-recess connection 80, 82.

The ends of the main grille bar 22 extend beneath the rail 82 within V-shaped notches of the rail 82 as noted earlier.

Once the rails 56, 82 have been positioned in overlying relation to the inserts 30, 39', 50, 70, as well as the ends of the main grille bar 21, those rails are attached to the primary frame part 58, e.g., by means of screws.

It will be appreciated that the decorative grille assembly 20 can be easily assembled upon the glazing panel 18 without the need for welding or special cutting of the ends of any of the grille bars. The rails are then merely laid onto the glazing panel 18 to retain the grille assembly 20 in place, and are secured to the frame 12 by screws.

In lieu of having three inner and outer secondary grille bars, it might be desirable to have more or less. For example, in FIG. 31 there is disclosed an insert 83 which contains two mounting portions 84, 84' adapted for connection with two inner secondary grille bars 85. Instead of having one long tab, the insert 83 has a pair of shorter tabs 86.

Furthermore, it may be desirable to configure the mounting portions in a manner which facilitates insertion thereof into the grille bars, while still obtaining a friction fit. Thus, as depicted in FIGS. 31 and 32, each mounting portion 84, 84' includes lateral slots 87 which define resiliently flexible lateral projections 88. Upon being inserted into the end of a grille bar, the projections can flex longitudinally (i.e., flex in the direction of insertion) to exert a bias against the inner surfaces of the grille bars, thereby resisting removal.

Such resilient mounting portions can also be provided on other inserts. For example, FIG. 33 and 34 depict such a mounting portion on an insert 90 which is otherwise similar to the previously described insert 50.

Another way of providing a resiliently biased mounting portion is depicted in FIGS. 27-29, and involves the presence, in an insert 92, of longitudinal slots 94, resulting in the formation of longitudinally extending, laterally flexible projections 96. The projections have chamfers 98 at their outer ends to facilitate insertion into a grille bar. Upon being inserted, the ends of the projections can flex laterally toward one another and thus bear frictionally against the inner surfaces of the grille bar.

Figure 23:
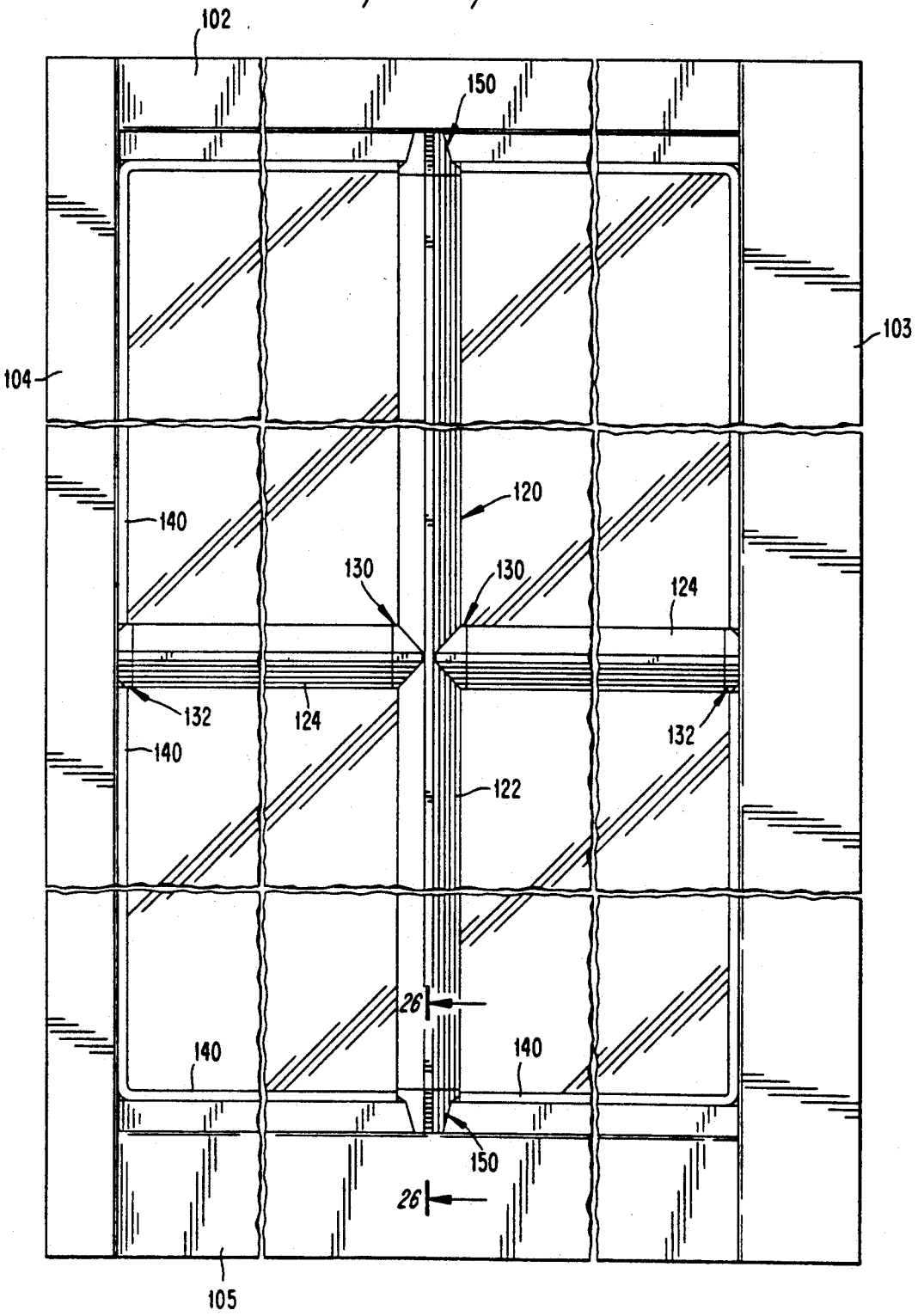
FIG. 23 is a front elevational view of a rectangular window which includes a grille assembly according to a second embodiment of the invention.
Figure 24:
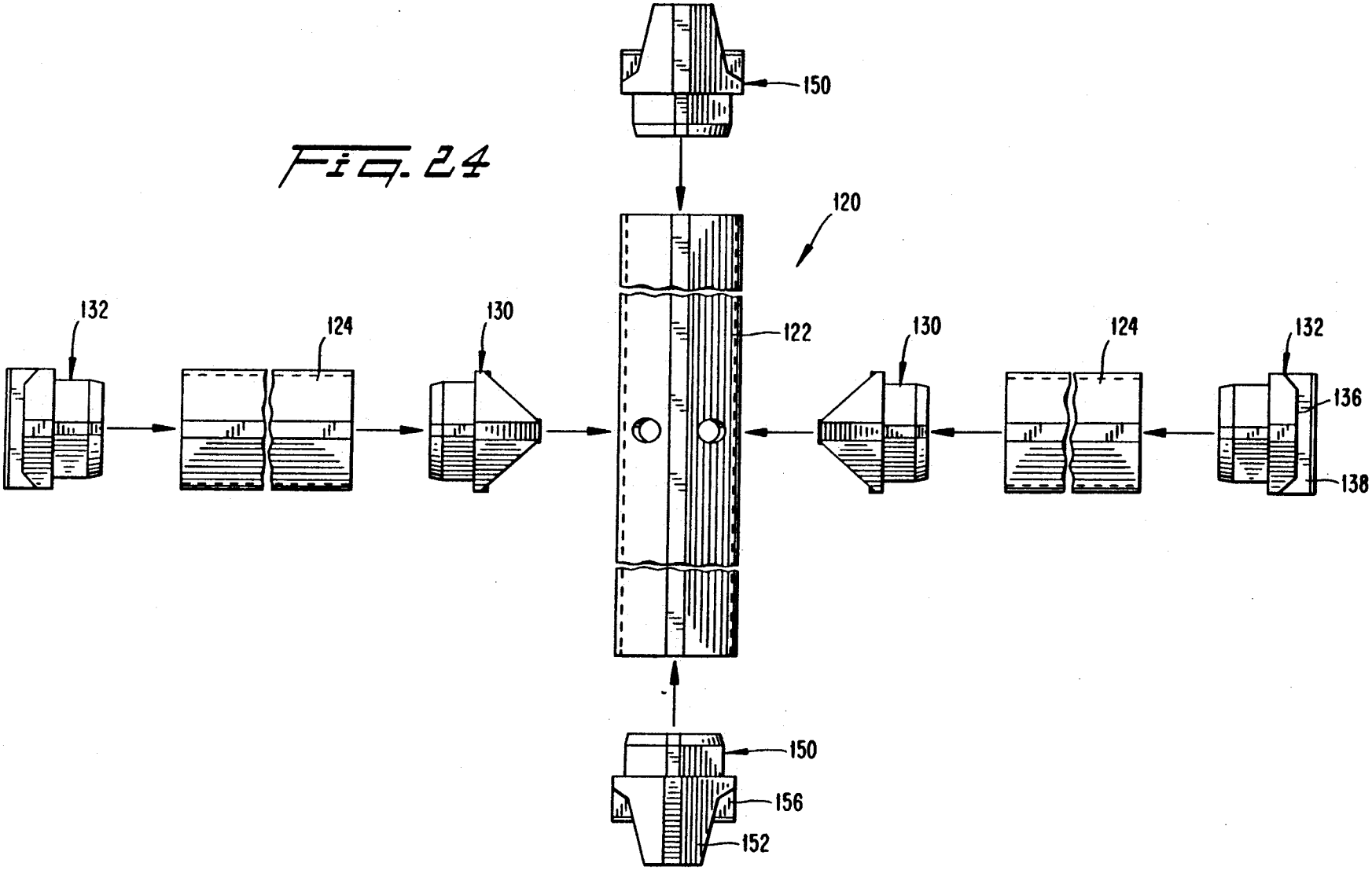
FIG. 24 is an exploded view of the grille assembly depicted in FIG. 23.

A second preferred embodiment of the invention is depicted in FIG. 23. That embodiment involves a rectangular window 99 having a frame 100 comprised of pairs of parallel metal frame parts 102, 103, 104, 105 secured together in a conventional manner by screw fasteners (not shown). The frame parts include a pair of parallel end frame parts 102, 105 and a pair of parallel side frame parts 103, 104. The window can be of the sliding type which is provided with a conventional locking mechanism on a side frame part 103.

Each of the end frame parts 102, 105 includes a pair of flanges 110, 112 (FIG. 26) spaced apart in the direction of the thickness of the window to form a slot in which the top and bottom faces of the glazing panel 18 can be received with clearance. The side frame parts are slidable laterally onto the end frame parts to overlie the corresponding edges of the glazing panel.

Mounted on one surface of the glazing panel is a grille bar assembly 120 which comprises a metal main grille bar 122 and a pair of metal secondary grille bars 124. The main grille bar 122 extends from one of the end frame parts 102 to the other 105, whereas the secondary grille bars 124 extend perpendicularly from opposite sides of the main grille bar 122 to respective ones of the side frame parts 103, 104.

Each of the secondary grille bars 124 is connected to the main grille bar 122 by a plastic insert 130 which is similar to the previously described insert 30. Moreover, each of the secondary grille bars is connected to the respective side frame part by a plastic insert 132 which is similar to the previously described insert 30, except for the presence of an undercut 134 (FIG. 30) situated between the face 136 and the tab 138. That undercut 134 is adapted to receive the ends of conventional insulation strips 140 which are adhered to the glazing panel and fitted into a gap formed between the glazing panel and an inner surface of the respective side frame part.

It will thus be appreciated that the inserts 130 are connected to the main grille bar and to the secondary grille bars by tongue-and-recess connections similar to the earlier described window 10. Likewise, the inserts 132 are connected to the frame and to the secondary grille bars by tongue-and-recess connections. Movement of the inserts along the side frame parts is prevented by the presence of the insulation strips.

The ends of the main grille bar 120 are connected to the flanges 110 of the end frame parts 102, 105 by means of plastic inserts 150. Each insert 150 is similar to the insert 132, except for the presence of a longitudinally projecting nose 152 disposed above the undercut 154 in order to define a slot aligned with the undercut, for receiving the flange 110 (see FIG. 26). It will be appreciated that the inserts 150 are connected to both the main grille bar 122 and the frame 100 by tongue-and-recess connections.

As explained earlier in connection with the earlier-described window 10, the grille bar assembly 120 can be assembled without the need to weld the grille bars together or to make specially shaped cuts in the grille bars. These advantages are achieved while still being able to form the grille bars of metal which can withstand being deformed under high temperatures that might be encountered, especially in the warmer climates.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A window unit comprising:
a frame;
a glazing panel mounted in said frame; and
a decorative grille assembly overlying said glazing panel and retained in place by said frame, said grille assembly comprising:
a plurality of grille bars formed of hollow metal extrusions, each grille bar including sides which converge in a direction away from said glazing panel, and
plastic inserts stationarily mounted in hollow ends of said metal grille bars and projecting longitudinally therebeyond, a first plurality of said plastic inserts interconnecting said grille bars by tongue-and-recess connections, and a second plurality of said plastic inserts interconnecting said grille assembly to said frame by tongue-and-recess connections, said first plurality of inserts each including a terminal end face inclined obliquely relative to said glazing panel to lie generally flush against one of said sides of a respective grille bar, said second plurality of inserts including tab portions;
said frame including removable rail means overlying said tab portions to define a tongue-and-recess connection.

2. A window according to claim 1, wherein each of said plastic inserts which interconnects said hollow metal grille bars together is press fit into an end of one hollow metal grille bar and includes a post projecting into a hole formed in a side wall of another hollow metal grille bar.

3. A window according to claim 1, wherein each of at least some of said plastic inserts are press fit into a hollow end of a respective hollow metal grille bar and includes a portion projecting longitudinally beyond said hollow metal grille bar and being of a similar cross-sectional shape as said hollow metal grille bar to define a longitudinal extension of said shape.

4. A window according to claim 1, wherein one of said hollow metal grille bars has opposite ends disposed adjacent respective portions of said frame and defines a main grille bar, others of said hollow metal grille bars defining secondary grille bars extending transversely from locations intermediate said ends of said main grille bar, said plastic inserts disposed in ends of said main and secondary grille bars.

5. A window according to claim 4, wherein some of said plastic inserts disposed in said secondary grille bars each includes a post received in a hole formed in a side wall of said main grille bar to define a tongue-and-recess connection.

6. A window according to claim 4, wherein said main grille bar is linear, said secondary grille bars extending perpendicular to said main grille bar.

7. A window according to claim 4, wherein said main grille bar is curved.

8. A window according to claim 1, wherein each of said hollow metal grille bars is of triangular cross-section, said plastic inserts including portions of triangular cross section press fit into hollow ends of said grille bars.

9. A glazing unit according to claim 1, wherein said inserts include mounting portions having a friction fit within said hollow ends, said mounting portions including flexible projections.

10. A glazing unit according to claim 9, wherein said projections are flexible laterally of a direction of insertion of said inserts into said hollow ends.

11. A glazing unit according to claim 9, wherein said projections are flexible in the direction of insertion of said inserts into said hollow ends.

12. A glazing unit comprising:

a frame including a linear section and a substantially semi-circular section;

a substantially semi-circular glazing panel mounted in said frame; and a decorative grille assembly overlying said panel and retained in place by said frame, and decorative grille assembly comprising:

a substantially semi-circular main grille bar having first and second opposing ends secured to spaced-apart portions of said linear section, a plurality of outer secondary linear grille bars extending in diverging relationship from said main grille bar to said semi-circular section of said frame, and a plurality of inner secondary linear grille bars extending in converging relationship from said main grille bar to said linear section of said frame, the inner secondary grille bars being in alignment with respective outer secondary grille bars, and a plastic insert connected to each of said inner and outer secondary grille bars at an end thereof adjoining said main grille bar, said insert being connected to said main grille bar by a tongue-and-recess connection.

* * * * *